United States Patent [19]

Hauser et al.

[11] Patent Number: 4,789,107

[45] Date of Patent: Dec. 6, 1988

[54] PROCESS AND APPARATUS FOR WINDING A THREAD SUPPLIED AT A CONSTANT SPEED ONTO A CROSS WOUND BOBBIN

[75] Inventors: Hans H. Hauser, Horgen; Arthur Rebsamen, Sellenburen; Walter Slavik, Horgen, all of Switzerland; Hans Landwehrkamp, Lenting, Fed. Rep. of Germany

[73] Assignee: Schubert & Salzer Maschinenfabrik Aktiengesellschaft, Ingolstadt, Fed. Rep. of Germany

[21] Appl. No.: 13,160

[22] Filed: Feb. 10, 1987

Related U.S. Application Data

[63] Continuation of Ser. No. 743,230, Jun. 7, 1985, abandoned.

[30] Foreign Application Priority Data

Jun. 19, 1984 [DE] Fed. Rep. of Germany ..... 3422637

[51] Int. Cl.[4] ..... B65H 59/38

[52] U.S. Cl. ..... 242/45; 242/18 DD

[58] Field of Search ..... 242/45, 18 DD, 18 CS

[56] References Cited

U.S. PATENT DOCUMENTS

| | | | |
|---|---|---|---|
| 3,860,186 | 1/1975 | Schiltknecht et al. | 242/45 |
| 3,945,579 | 3/1976 | Schippers et al. | 242/45 X |
| 4,089,480 | 5/1978 | Kamp | 242/45 X |
| 4,327,873 | 5/1982 | Juppet et al. | 242/45 |

FOREIGN PATENT DOCUMENTS

| | | | |
|---|---|---|---|
| 0094725 | 11/1983 | European Pat. Off. | 242/45 |
| 1923847 | 11/1969 | Fed. Rep. of Germany | 242/45 |
| 1912374 | 5/1970 | Fed. Rep. of Germany DD | 242/18 |
| 289894 | 6/1965 | Netherlands | 242/18 DD |

*Primary Examiner*—Stanley N. Gilreath

*Attorney, Agent, or Firm*—Dority & Manning

[57] ABSTRACT

When a thread (10) supplied at a constant speed is wound onto a cross-wound bobbin (11), the variations in thread tension are compensated, and in addition predetermined thread-tension limiting values are prevented from being exceeded as a result of a change in the winding-on speed. A first regulating system (96) is provided for compensating periodic variations in the thread tension, while a second regulating system (51) is provided for compensating shifts in the range of thread tensions. The second regulating system is designed as a variable step-up gear (5), the drive part (60) of which is connected to a drive shaft (4) extending over several spooling stations. The output part (62) of this step-up gear (5) is connected to the spooling roller (3), the drive part (60) being connected to the output part (62) by means of a transmission member (61) which determines the gear ratio at any particular time and which is adjustable as a function of the thread tension. The drive part (60) and the output part (62) are both designed as cone wheels, between which the transmission member (61) is continuously adjustable. The transmission member (61) has assigned to it an adjustable basic position and a return device (89) for returning to a basic position determining the maximum step-up ratio.

38 Claims, 6 Drawing Sheets

FIG. 2
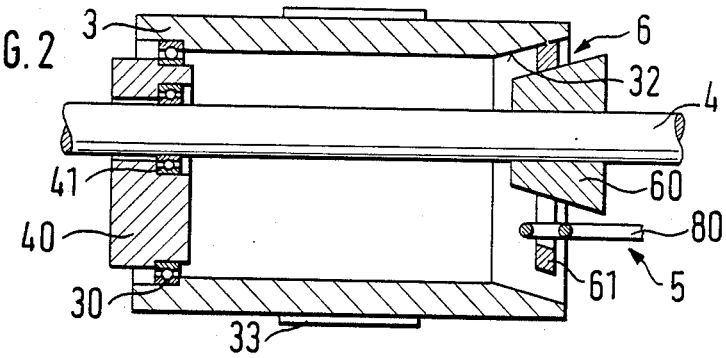
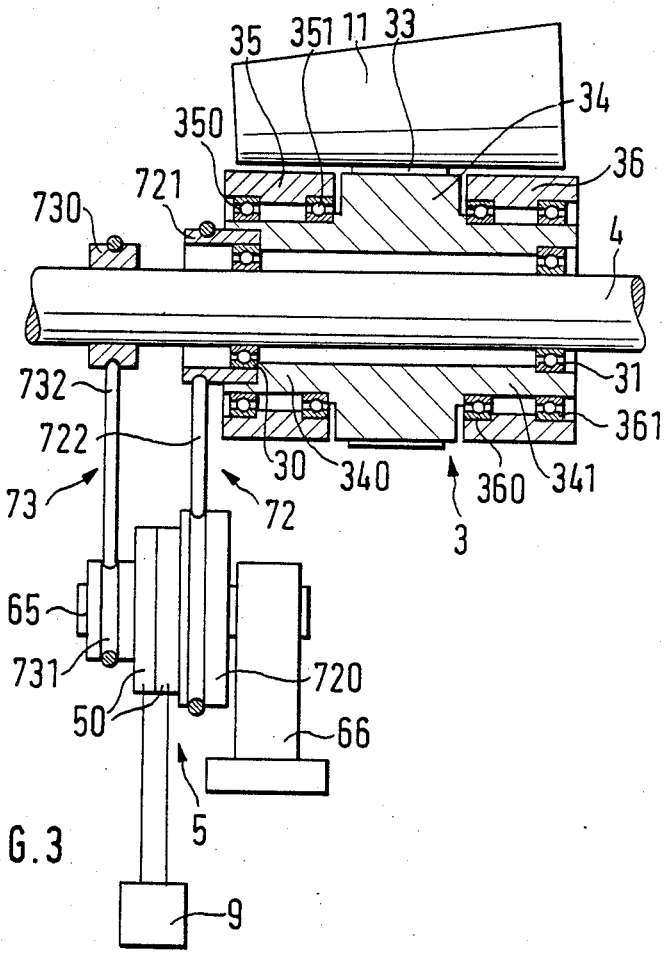
FIG. 3

PROCESS AND APPARATUS FOR WINDING A THREAD SUPPLIED AT A CONSTANT SPEED ONTO A CROSS WOUND BOBBIN

This is a continuation of application Ser. No. 743,230 filed June 7, 1985 now abandoned.

The present invention relates to a process for winding a thread supplied at a constant speed onto a cross-wound bobbin and to an apparatus for carrying out this process.

Cross-wound bobbins of this type are driven over their periphery, so that a constant circumferential speed is obtained in the drive region. When the thread is supplied at a constant rate, as occurs on open-end spinning machines and also on many spooling machines, it is merely necessary to compensate the varying path of the thread over the width of the bobbin, and this can usually be achieved by relatively simple means, for example a curved threadguide rail. When the bobbins are driven over a portion of their length, differing diameters resulting in differing circumferential speeds arise in the working region and also outside it. The problem becomes even greater when conical bobbins are concerned, since, in addition to this varying thread path over the width of such a bobbin, there are large differences in diameter because of the bobbin conicity, so that considerable variations occur in the thread length wound on during each bobbin revolution. The resulting bobbin is consequently wound unevenly, and this can lead to layers of thread which tapper off and to difficulties in further processing, and even to thread breakages.

To compensate these differences in thread length, it has already been proposed to drive the bobbin at an alternating speed (German Offenlegungsschrift No. 2,458,853). For this purpose, the drive station on this known apparatus is shifted parallel to the outer surface of the conical cross-wound bobbin. This is effected, for example, by moving the actual element driving the conical cross-wound bobbin to and fro along the cross-wound bobbin (FIGS. 3 and 4). The yarn is thereby subjected to very rough handling by the drive element movable along the cross-wound bobbin, and this stress increases, the larger the bobbin being built up, since with an increase in weight of the bobbin the drive element presses more forcefully into its turns. Such an apparatus is automatically out of the question when high contact pressure forces are exerted, particularly because of the yarn damage caused thereby. Furthermore, the drive transmission is very poor because of the short width of such a movable drive element, thus making it impossible to match the desired speed exactly, owing to slippage. According to another design (FIGS. 1 and 2), the drive station is shifted relative to the conical cross-wound bobbin due to the fact that the conical cross-wound bobbin rests on a plurality of supporting rollers, any one of which can take over the drive. It is necessary to have, for this purpose, an axially displaceable drive roller, the stroke range of which extends from the first supporting roller at one end of the bobbin to the last supporting roller at the other end of the bobbin. Because of the long stroke distance of this drive roller, this too is subject to relatively high wear. Moreover, the drive speed for the cross-wound bobbin can only be changed in steps according to the number of supporting rollers. When there are only a few supporting rollers, these steps are very large. When there is a large number of supporting rollers, the supporting region transmitting the drive is very small, this resulting again in poor drive transmission. In both cases, the thread tension is not taken into account at all, so that the conical cross-wound bobbins produced are not wound uniformly.

In another known apparatus (German Patent Specification No. 1,912,374), the spooling roller consists of two or more part rollers which can be brought selectively via controllable couplings into driving connection with the drive shaft carrying them. The couplings are controlled by a pendulum arm, over which the thread to be wound on is laid in the form of a loop, so that the conical cross-wound bobbin is driven according to the size of the thread loop and therefore at different circumferential speeds. Changes in thread tension are matched only very approximately by means of this apparatus, since for constructional reasons there is only room for a limited number of couplings between the drive shaft and spooling roller.

To control the spooling speed, it is also known to arrange the spooling roller on a pivotable spooling-roller holder axially displaceable relative to the drive shaft, a friction wheel of a bevel-wheel friction gear being arranged both on the drive shaft and on the spooling roller (German Patent Specification No. 2,328,993). Thus, whenever the spooling speed changes the spooling roller executes an axial relative movement in relation to the bobbin which results in damage to the yarn. A particular disadvantage of the known apparatus is that a relatively large space has to be kept free next to each bobbin for the movable bobbin holder.

The object of the invention is, therefore, to avoid the disadvantages mentioned and to provide a process and an apparatus for producing uniformly wound, especially conical cross-wound bobbins, which allow the thread to be wound on with a uniform thread tension at each spooling station, the apparatus being of simple and compact design.

This object is achieved, according to the invention, because variations in thread tension are compensated and, in addition, predetermined thread-tension limiting values are prevented from being exceeded as a result of a change in the winding-on speed. Thus, during the formation of the first turns on a newly inserted tube, the variations in thread tension occurring when the thread is wound on are compensated because the thread is deflected. Subsequently, when the bobbin has increased in size and an elastic ply layer consisting of the wound-on thread turns has formed, the resulting shift of the range of the variations in thread tension is compensated by the change in the winding-on speed.

In order reliably to prevent over reaction between the winding-on speed and the thread-tension compensation and consequently distortion of the control, according to an advantageous embodiment of the process according to the invention the cross-wound bobbin is driven at a maximum circumferential speed which is fixed by the desired tension on the thread and which is reduced to avoid shifts in the range of the variations in thread tension. The quarantees faultless running, with a uniform tension on the thread, over the entire period of the bobbin build-up, even when conical cross-wound bobbins are concerned.

To carry out the process described, there are, according to the invention, a first regulating system for compensating periodic variations in thread tension and a second regulating system for compensating shifts in the range of thread tensions. This ensures in a simple way that a constant tension on the thread is maintained during the time when the thread is wound on.

According to a preferred design of the subject of the invention, the first regulating system consists of a thread-tension sensor which can be made to act on the second regulating system in the event of a shift of a predetermined range of thread tensions. Thus, the first regulating system serves at the same time as a monitoring system which checks whether the predetermined range of thread tensions is exceeded. There is, therefore, no need for a separate monitoring system to control the second regulating system.

According to particularly advantageous design of the apparatus according to the invention, the second regulating system is designed as a variable step-up gear, or transmission the drive part of which is connected to a drive shaft, extending over several spooling stations, and the output part of which is connected to the spooling roller, the drive part being connected to the output part by means of a transmission member determining the gear ratio at any particular time and connected to the first regulating system. Since both the drive part and the output part are axially immovable and the transmission member determining the gear ratio is located between this drive part and the output part, there are no elements moved along the cross-wound bobbin or the spooling roller, so that there is no danger of faults caused by deposits resulting from the abrasion of an element displaceable along the spooling roller. Since not only are engageable and disengageable couplings arranged in front of the spooling roller, but a controllable step-up gear or transmission is also used, the rotational speed of the drive is not simply transmitted to the spooling roller, but on the contrary the spooling roller is usually driven at a speed different from the rotational speed of the drive, and by means of the controllable step-up gear the spooling speed of the spooling roller can be varied within a wide range. Because the transmission member is controlled as a function of the first regulating system and consequently also as a function of the sensed thread tension, cross-wound bobbins which are wound to a uniformly high quanlity are always obtained. This is further assisted by the fact that the width of the surface which the rotation of the spooling roller transmits to the bobbin does not have to be selected as a function of the desired spooling speed, but can be selected freely.

Within the meaning of the present invention, "spooling roller" refers to any element by means of which the cross-wound bobbin is driven over its periphery, irrespective of whether this element extends over the entire length of the cross-wound bobbin or only over a more or less large part region of it.

According to a preferred design of the subject of the invention, the step-up gear can be set at a maximum step-up ratio which cannot be exceeded. This prevents in a simple way any retroaction of the winding-on speed on the thread-tension compensation.

Advantageously, the transmission member is continuously variable, so that changing conditions can be matched very accurately and thus producing a conical cross-wound bobbin which is always formed in a desired way from start to finish and which can therefore also be used in the most efficient way possible in subsequent processing stages.

In principle, the controllable step-up gear can be of varying design and can also have differently designed transmission members, for example in the form of the eddy current of an eddy-current coupling or clutch or the magnetic powder of a magnetic-particle coupling which transfers to the extent desired a rotational speed imparted to it. Instantaneous couplings, however, react differently at each response. To achieve specific conditions, it is therefore expedient, in a transmission member designed in this way, to sense the rotational speed of the spooling roller and control the coupling as a function of the desired conditions and the actual rotational speed of the spooling roller. To avoid these expensive electronics and thus ensure a moderately priced control of the spooling roller which furthermore is also inexpensive because of a small space requirement, according to a preferred design both the drive part and the output part are designed as cone wheels, between which the transmission member is axially adjustable. In such an embodiment of the step-up gear, it has proved particularly advantageous to design this transmission member as a rigid collar. This ensures that, irrespective of the particular position of the transmission member, the spooling roller always assumes the same radial position, so that the particular bobbin diameter can be monitored in a simple way by means of a stationary light barrier. As a result of such a design of the subject of the invention, the step-up gear can be matched particularly quickly to changing conditions.

So that the desired maximum step-up ratio of the step-up gear and consequently the maximum circumferential speed of the cross-wound bobbin can be fixed in a simple way, in an appropriate embodiment of the apparatus according to the invention an adjustable basic position is assigned to the transmission member and there is a return device for returning the transmission member to this basic position determining the maximum step-up ratio. When the transmission member is part of a cone gear, this basic position can advantageously be fixed by a stop assigned to the transmission member. In this case, the adjustable stop is advantageously assigned to an adjusting fork stressed by the return device and intended for the transmission member, and it has proved expedient to arrange the adjustable stop on the adjusting fork.

In a simple embodiment of the apparatus according to the invention, the return device can be designed as a restoring spring, but the return device is preferably designed as converging outer surfaces of the cone wheels. The converging outer surfaces of the drive wheel and output wheel exert a force on the step-up member to return the latter to its basic position. For this purpose, the cone wheel forming the output part can be mounted on an axle which is inclined relative to the drive shaft carrying the cone wheel forming the drive part. At the same time, the inclination of the axle can be adjustable. For this purpose, the adjustable axle is advantageously mounted on a lever, to which an adjusting cam is assigned.

In an alternative preferred design, the cone wheels have different conicities. It is advantageous, here, if the outer surfaces of the transmission member also have different conicities matching the conicities of the cone wheels. Another advantage of the return device is that as a result of the displacement of the transmission member transmission between the cone wheels also occurs at different points, so that excessive wear along a single peripheral line of the cone wheels is avoided.

According to a particularly simple embodiment of the subject of the invention, the step-up gear has a singlestage step-up ratio, and according to an appropriate design the spooling roller is mounted excentrically relative to a drive shaft by means of a bearing receiving the drive shaft and the output part is designed as a conical inner contour. This ensures that, irrespective of the particular position of the transmission member, the spooling roller always assumes the same radial position, so that the particular bobbin diameter can be monitored in a simple way by means of a stationary light barrier. According to a further advantageous embodiment of the apparatus according to the invention, the drive shaft is arranged outside the spooling roller.

According to a preferred design of the subject of the invention in which the drive roller is appropriately arranged concentrically inside the spooling roller, the step-up gear is connected to the spooling roller and/or to the drive shaft via a further gear. The rotation is thus transferred from the drive shaft to an intermediate shaft, the transmission member or the like, from which the rotation is then transferred to the spooling roller mounted concentrically relative to the drive shaft. It has proved expedient, here, to arranged the further gear between the output part and the spooling roller.

Stepping up can be effected in various ways, for example by means of toothed or friction wheels or chains. It is particularly simple and quite sufficient to design the further gear as a cord drive.

The control connection between the thread-tension sensor forming the first regulating system and the step-up gear forming the second regulating system can be made in any customary known way, for example electrically. However, mechanical solutions have proved particularly inexpensive. According to a preferred mechanical control connection between the thread-tension sensor and the step-up gear, the thread-tension sensor has a bar which senses the tension of the thread supplied to the spooling device and which is connected by means of a linkage to the transmission member of the step-up gear.

So that the thread-tension sensor can be lifted out of the thread run during an automatic piecing operation carried out by means of a servicing device movable along a plurality of spooling stations, as is necessary, for example, on open-end spinning machines, in a further advantageous embodiment of the subject of the invention the thread-tension sensor has a nose extending parallel to the spooling roller, for interaction with an adjusting lever of this servicing device which can be advanced selectively to a plurality of spooling stations.

To achieve a particularly accurate response of the first regulating system, the thread-tension sensor advantageously consists of plastic.

To prevent even very small brief tension peaks from resulting in a change in the step-up ratio, so that the first regulating system has no effect on the second regulating system within a predetermined range of variations in thread tension, there is advantageously in the connection between the bar and the linkage a slot appropriately of adjustable size. The sensitivity of the apparatus according to the invention and/or the position of the thread-tension range can be adjusted as a result.

In an alternative advantageous embodiment the thread-tension sensor can have a guide for a connecting rod forming part of the linkage, with an adjustable stop which can be brought up against the thread-tension sensor and via which the transmission member can be moved out of its basic position. To avoid damage between the connecting rod and the transmission member, an elastic coupling member transmitting the relative movements can be provided here.

To avoid the danger, during the formation of conical cross-wound bobbins, that the start of the thread reserve formed at the end of the larger diameter of the conical cross-wound bobbin will possibly penetrate into the step-up gear, the latter is advantageously arranged at the end of smaller diameter of the conical cross-wound bobbin inserted in the spooling device.

Since the rotating conical cross-wound bobbin, because of its conicity, has different circumferential speeds in its various length regions, it is appropriate if the spooling roller has at least two loose pulleys and a drive pulley arranged between these loose pulleys and driving the cross-wound bobbin. The loose pulleys serve merely as a bobbin supporting element, while the bobbin alone is driven via the drive pulley. It has proved advantageous to arrange the drive pulley not centrally relative to the inserted bobbin but between the loose pulleys and offset in the axial direction towards the larger diameter of the conical cross-wound bobbin inserted in the spooling device, and different numbers of loose pulleys can also be provided on both sides of this cross-wound bobbin.

According to an embodiment of the subject of the invention which allows a particularly narrow design and therefore a particularly close "division" of the spooling devices, the drive pulley can be driven via its outer periphery.

If the drive pulley of a multi-stage spooling roller is not to be driven via is periphery, in an appropriate embodiment of the apparatus according to the invention the drive pulley is connected via a sleeve-like connecting piece to a drive element provided at one end of the spooling roller and drive from the step-up gear, the loose pulley arranged between the drive pulley and drive element being mounted on this sleeve-shaped connecting piece. The drive pulley advantageously has, on its end facing away from the sleeve-like connecting piece, a sleeve-like extension for mounting at least one further loose pulley.

Irrespective of whether the spooling roller is driven via its outer periphery or via its end, to achieve a better take-up of the cross-wound bobbin the spooling roller advantageously has a surface purposely designed as a take-up surface, and this can be achieved by means of an appropriate choice of material for this surface or as a result of the profiling of the latter.

The subject of the invention has a simple construction, is reliable to operate and space-saving and can easily be matched to varying thread tensions and winding-on conditions. The apparatus makes it possible to achieve precise control in spite of a high spool speed, so that both accurate cylindrical and accurate conical cross-wound bobbins are produced.

Various embodiments are explained in more detail below with reference to drawings in which:

FIG. 2 shows, in section, a modification of the subject of the invention;

FIG. 3 shows, in a front view partially in section, a further modification of the apparatus according to the invention, with a transmission member designed as part of an instantaneous coupling and with a multi-part spooling roller; the subject of the invention with a drive shaft arranged outside the spooling roller;

Figure 1:
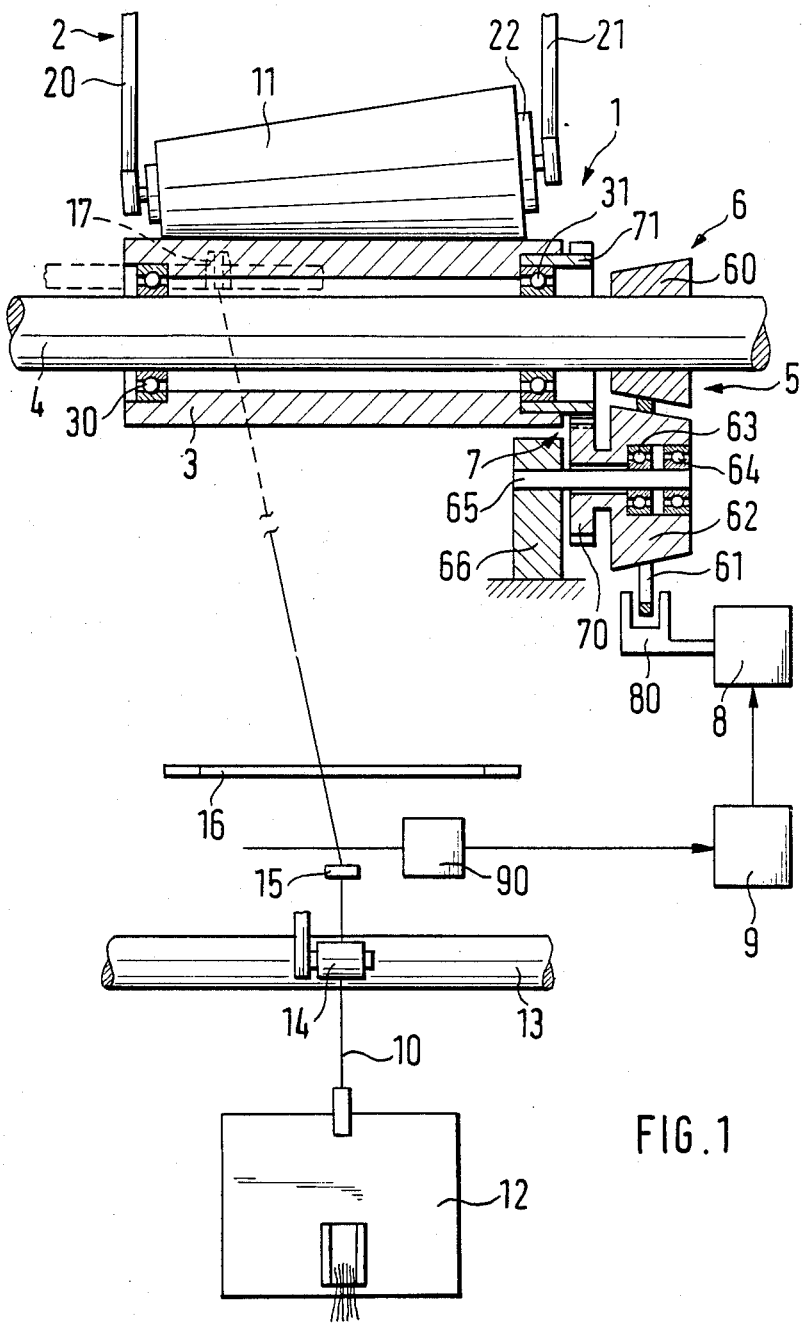
FIG. 1 shows, in a front view partially in section, a first exemplary embodiment of a spooling station designed according to the invention, with a step-up gear designed as a cone gear.

The spooling apparatus 1 described first and illutrated in FIG. 1 is part of an open-end spinning machine for producing conical cross-wound bobbins 11, but the invention can also be put into practice on other textile machines which have spooling stations or spooling apparatuses 1 for forming cylindrical or conical cross-wound bobbins 11.

As shown in FIG. 1, each spooling apparatus 1 consists essentially of a bobbin mounting 2, an individual axially immovable spooling roller 3 and a likewise axially immovable drive shaft 4 driving the spooling roller 3 via a controllable step-up gear 5.

In the embodiment illustrated, the bobbin mounting 2 has two bobbin arms 20 and 21 for receiving a conical tube 22, on which the conical cross-wound bobbin 11 driven by the spooling roller 3 by means of friction forms when the thread 10 is wound on.

The spooling roller 3 is mounted on the drive shaft 4 so as to be freely rotatable by means of two roller bearings 30 and 31. Connected fixedly in terms of rotation to one end of the spooling roller 3 is a toothed wheel 71 which is part of a spur gear 7 arranged between the said step-up gear 5 and the spooling roller 3. The drive shaft 4 is assigned jointly to a plurality of spooling apparatuses 1 arranged next to one another and accordingly extends over this plurality of spooling apparatuses. So that each cross-wound bobbin 11 can nevertheless be driven individually, the spooling roller 3 is not driven directly by the drive shaft 4, but with the controllable step-up gear 5 interposed.

The step-up gear 5 illustrated in FIG. 1 has a controllable cone gear 6 and a non-controllable spur gear 7. The step-up gear 5 or variable transmission possesses a drive wheel which is connected to rigidly to the drive shaft 4 and is designed as a cone wheel 60 and with which an output wheel designed as a cone wheel 62 interacts, with a transmission member 61 interposed. The transmission member 61, designed as a rigid collar in the embodiment illustrated, can be adjusted parallel to the generating lines of the two cone wheels 60 and 62, as described in more detail later. The cone wheel 62 is mounted by means of roller bearings 63 and 64 on an axle 65 which itself is carried by a bearing 66. Connected fixedly in terms of rotation to the cone wheel 62 is a spur wheel 70 which is engaged with a spur wheel 71 connected to the spooling roller 3.

The transmission member 61 is guided by an adjusting fork 80, to which a suitable drive 8 is assigned. For example, the drive 8 can be designed as a stepping motor which can rotate forwards and backwards and which engages via a pinion into a rack connected to adjusting fork 80. Such a stepping motor is inexpensive and does not require a regulating device to control it, so that the outlay in control terms is low. Furthermore, such a drive makes it possible to achieve very fine adjustment steps practically equivalent to a continuous adjustment of the transmission member 61. The drive 8 is connected to a control device 9 which itself is connected in control terms to a thread-tension sensor 90.

As emerges from the subsequent description, the thread-tension sensor 90 constitutes a first regulating system 96, while the step-up gear 5 constitutes a second regulating system 51.

Where the open-end spinning machine illustrated is concerned, the thread 10 to be wound on is produced continuously in a spinning apparatus 12 and is drawn off from this by means of draw-off rollers 13 and 14. The thread 10 then passes a stationary thread guide 15 and a thread-tension compensating bar 16. The thread 10, executing a pendulum movement, is presented to the tube 22 to form a cross-wound bobbin 11 by means of a traversing thread guide 17 (indicated by a broken line).

It is usually possible, during the formation of a cylindrical cross-wound bobbin (not shown), to compensate the variations in thread tension occurring as result of the traversing thread feed by means of such a thread-tension compensating bar 16. However, where a conical cross-wound bobbin 11 is concerned these variations are too great and, above all, change considerably during the production of the conical cross-wound bobbin. On a typical conical cross-wound bobbin, for example the circumferential ratio between the small bobbin diameter and large bobbin diameter changes continuously from 10:16 to 10:11. This shows that it is impossible by means of a rigid compensating element, such as a thread-tension compensating bar, to compensate the variations in thread tension with equal effectiveness in the course of the production of a conical cross-wound bobbin 11. However, this can even sometimes be difficult on cylindrical cross-wound bobbins 11.

In the apparatus described above, the thread 10 fed to the spooling apparatus 1 is sensed by the thread-tension sensor 90. Any change in the thread tension is signalled to the control device 9 which in response to this change in thread tension controls the drive 8 and shifts the transmission member 61 of the cone gear 6 parallel to the cone wheels 60 and 62. The step-up ratio of the step-up gear 5 changes as result. The speed of the spooling roller 3 for the conical cross-wound bobbin 11, which is driven by the drive shaft 4 via the step-up gear 5, changes according to the change in thread tension, so that the thread winding-on speed generated always corresponds, allowing at the same time for the change in the thread run, to the constant thread feed speed at which the thread 10 is drawn off from the spinning apparatus 12 by the draw-off rollers 13, 14. Thus, the first regulating system 96 formed by the thread-tension guide 90 causes, together with the second regulating system 51 formed by the step-up gear 5, the thread 10 to be wound on with a constant tension.

Figure 5:
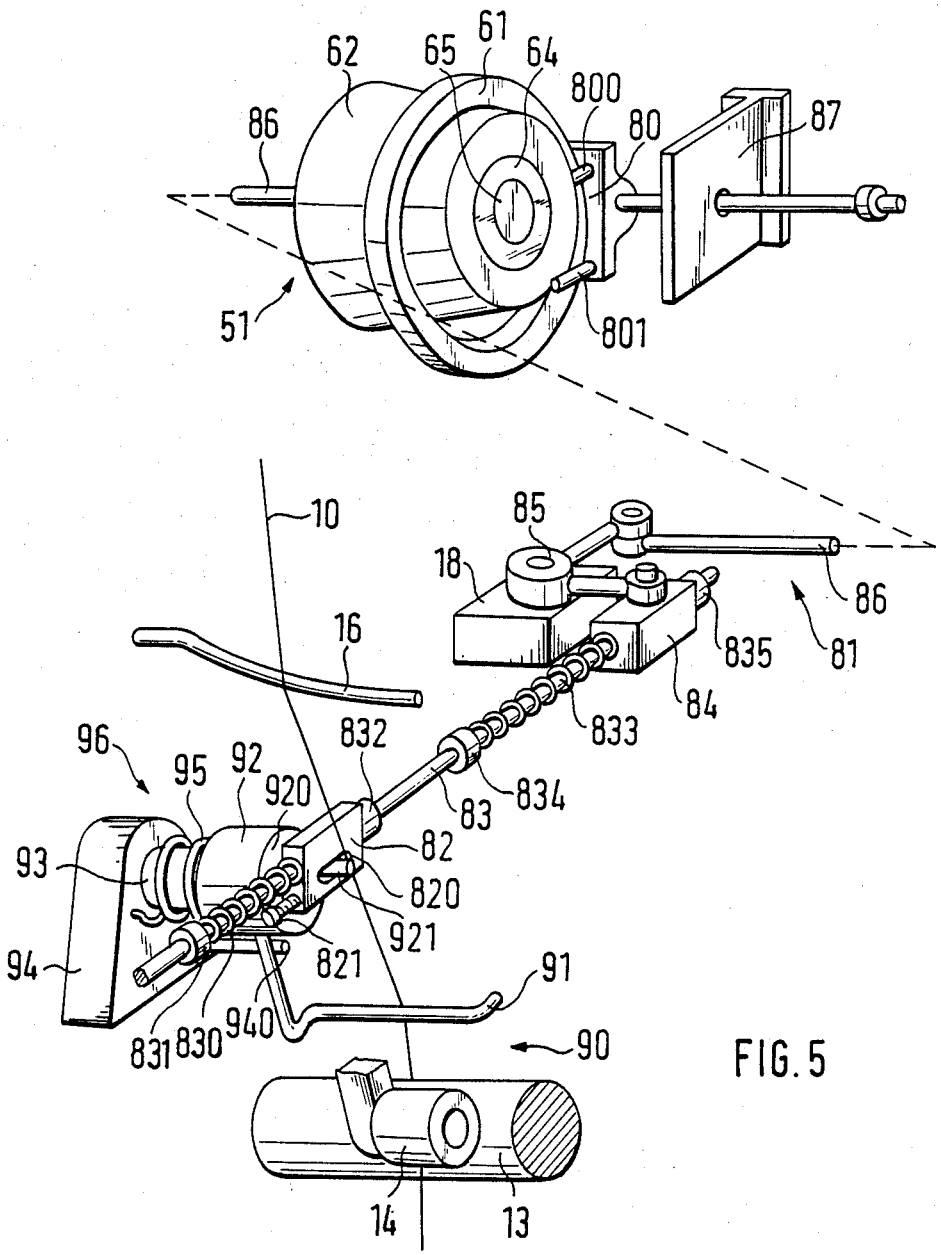
FIG. 5 shows, in perspective view, a mechanical control device for the apparatus according to the invention.

The cone wheel 62 of the cone gear 6, its transmission member 61 and the adjusting fork 80 are shown in a perspective view in FIG. 5. As this illustration clearly shows, the transmission member 61 is designed as a rigid collar displaceable axially parallel to the generating line of the two cone wheels 60, 62. The dimensions of the rigid collar are such that the cone 62 which it encloses is always surrounded by it with play irrespective of the current position. This is the case when the inside diameter of the rigid collar is greater than the maximum outside diameter of the cone wheel 62 surrounded by it.

The transmission member 61 designed as a rigid collar is guided between two pairs of engaging pins 800 and 801, only one engaging pin of each of these pairs being visible in Figure 5.

When the transmission member 61 is designed as a rigid collar, it is especially wear-resistant and therefore has a long service life in comparison with other designs, in which, for example, a cord, a belt or the like is used as a transmission member. Moreover, such a rigid collar reacts especially quickly to the adjusting movements imparted to it, so that it becomes possible by means of a rigid collar to match changing conditions very quickly.

In the exemplary embodiment described above, there is, in addition to the controllable step-up gear 5, a further gear 7 with a non-controllable step-up ratio. This is particularly advantageous when, as shown in FIG. 1, the drive shaft 4 is arranged inside the spooling roller 3, since it then becomes possible to arrange the spooling roller 3 and drive shaft 4 concentrically. Furthermore, according to the design illustrated in FIG. 1, the controllable step-up gear 5 is arranged between the drive shaft 4 and the non-controllable spur gear 7. The reason for this is that there must be a certain amount of space next to the spooling roller 3 for fastening the drive wheel (cone wheel 60) carried by the drive shaft 4, while the spur wheel 71 is fastened to the spooling roller 3 inside the latter. Since a cone wheel of a cone gear 6 is in any case wider than a spur wheel of a spur gear 7 because of the desired possibility of adjustment, it is this cone gear 6 with the controllable step-up ratio which is arranged between the drive shaft 4 and the further gears 7 with the non-controllable step-up ratio.

In the exemplary embodiment described above, a two-stage step-up ratio is provided, but instead of this a single step-up stage or more than two step-up stages can also be used.

A single-stage step-up is illustrated by way of example in FIG. 2. Here, the drive shaft 4 is mounted on each spooling apparatus 1 by means of a roller bearing 41 in a stationary bearing 40, on which one end of the spooling roller 3 is on the other hand also mounted by means of a roller bearing 30. At its other end, the spooling roller 3 has a conical inner contour 32. This inner contour 32 designed as a hollow cone constitutes the output part, connected rigidly to the spooling roller 3, of the step-up gear 5 designed as a cone gear 6. This inner contour 32 interacts via the transmission member 61 with the drive part arranged on the drive shaft 4 so as to be axially immovable and designed as a cone wheel 60. As described with reference to FIG. 1, the transmission member 61 is controlled by means of the adjusting fork 80 in order to change the step-up ratio.

So that this step-up gear 5 can be arranged between the drive shaft 4 and spooling roller 3, the spooling roller 3 is arranged excentrically relative to the drive shaft 4, to allow the transmission member 61 to execute an adjusting movement.

The conical cross-wound bobbin 11, because of its conicity, is driven at the same angular speed, but at different circumferential speeds in its various length regions, and consequently, in the length regions in which the circumferential speed of the cross-wound bobbin 11 differs from that of the spooling roller 3, the thread 10 located on the cross-wound bobbin 11 is subjected to greater friction, this having an adverse effect on the thread 10. To remedy this, therefore, the spooling roller 3 illustrated in FIG. 2 has in its middle length region a surface designed as a take-up surface 33, while the remaining length regions of the spooling roller 3 have a coefficient of friction which is low relative to the thread 10 and serve merely as a supporting element. By means of a suitable choice of material or as a result of appropriate profiling or by means of a combination of both measures, the take-up surface 33 can have a good take-up property in relation to the cross-wound bobbin 11. Since the take-up surface 33 and the remaining length regions of the spooling roller 3 which serve as supporting elements do not have to be selected as a function of a desired change in speed, their dimensions can be chosen so that good transmission of the rotary movement to the conical cross-wound bobbin 11 is always guaranteed.

A further development of a spooling roller 3 of this type is now described with reference to FIG. 3. According to this design, the spooling roller 3 mounted on the drive shaft by means of roller bearings 30 and 31 has a drive pulley 34, from which a sleeve-like connecting piece 340 extends to a cord pulley 721 and is connected fixedly in terms of rotation to this. A loose pulley 35 is mounted on this sleeve-like connecting piece by means of roller bearings 350 and 351. The drive pulley 34, on its side facing away from the cord pulley 721, continues up to the end of the spooling roller 3 likewise in the form of a sleeve-like extension 341 and carries a further loose pulley 36 by means of roller bearings 360 and 361. The drive pulley 34 again has a surface designed as a take-up surface 33. When the thread 10 is wound onto the cross-wound bobbin 11, the two loose pulleys 35 and 36 are not driven by the drive shaft 4, but by the cross-wound bobbin 11, so that the friction resulting from slip between the cross-wound bobbin 11 and the loose pulleys 35 and 36 of the divided spooling roller 3 is greatly reduced.

Figure 4:
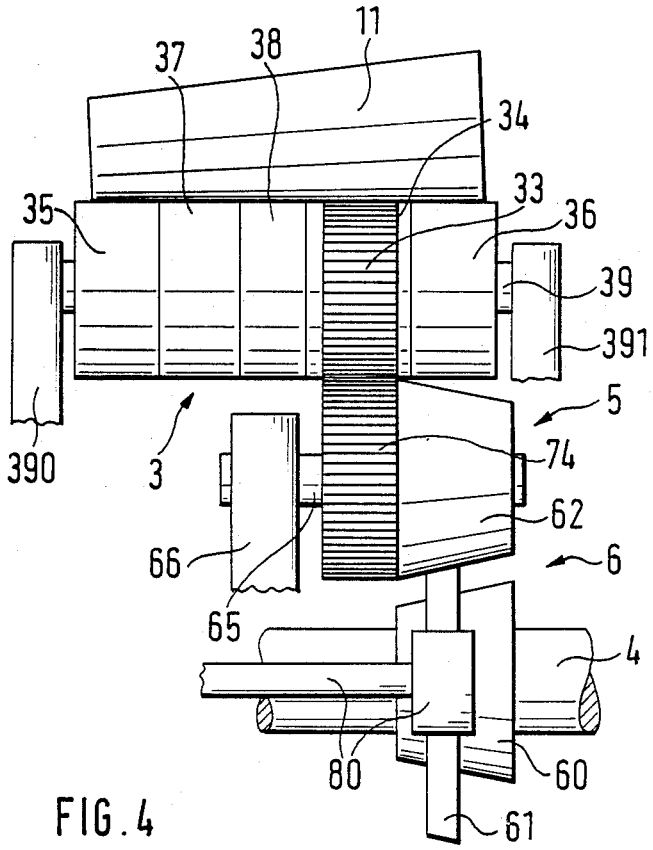

As shown in FIG. 4, there can also be more than just two loose pulleys 35 and 36. In this csae, it is also unnecessary to arrange the drive pulley 34 of the roller 3 centrally between the loose pulleys. Because of the higher friction caused by the greater mass on the larger diameter of the cross-wound bobbin 11, it is expedient if, as shown in FIG. 4, the drive pulley 34 is arranged excentrically in the spooling roller 3 so as to be offset in the direction of the larger diameter of the cross-wound bobbin 11. According to FIG. 4, this is achieved by means of loose pulleys of different sizes on the two sides of the drive pulley 34, and because three loose pulleys 35, 37 and 38 are arranged on the side of the cross-wound bobbin 11 with the smaller diameter, whereas only a single loose pulley 36, if appropriate somewhat wider than the loose pulleys 35, 37 and 38, is provided on the side of the cross-wound bobbin 11 with the larger diameter.

As shown in FIG. 3, the step-up gear or variable transmission 5 can be arranged and designed differently from the embodiment illustrated in FIG. 1. Since on conical cross-wound bobbins 11 a possibly desirable thread reserve is always formed at the end of the tube 22 (FIG. 1), at which the cross-wound bobbin 11 has the larger diameter, it can happen that the thread end penetrates into the step-up gear 5 and consequently results both in a drawing off of the thread reserve from the tube 22 and in a faulty step-up gear 5. According to FIG. 3, therefore, to remedy this the step-up gear 5 is arranged at the end of smaller diameter of the cross-wound bobbin 11 inserted in the bobbin mounting 2.

According to FIG. 3, the controllable step-up gear 5 used is an instantaneous coupling 50 arranged between two cord drives 72 and 73 and at the same time forming the transmission member. The first cord drive 73 possesses a cord pulley 730 which is arranged fixedly in terms of rotation on the drive shaft 4 and which drives a cord pulley 731 via a cord 732. This cord pulley 731 sits together with a further cord pulley 720 on a common axle 65 carried by the bearing 66. The two cord pulleys 731 and 720 are connected to one another via the instantaneous coupling 50, for example an eddy-current or magnetic-particle coupling or clutch, which is controlled from the control device 9. The abovementioned cord pulley 721 is driven by the cord pulley 720 via a cord 722.

It is possible in this design too, to match the drive speed of the cross-wound bobbin 11 exactly to the desired thread tension, since the instantaneous coupling 50 allows the rotary movement of the cord pulley 731 to be transmitted to the cord pulley 720 to the desired extent only. Thus, the drive pulley 34 and consequently the cross-wound bobbin 11 are again not drive directly by the drive shaft 4. On the contrary, their speed depends on the control of the instantaneous coupling 50.

Depending on the desired control accuracy, the instantaneous coupling 50 can be controlled in a plurality of steps or preferably continuously by the control device 9. However, even when the instantaneous coupling 50 is controlled in steps, this control is substantially more accurate than in the known state of the art, where various couplings are used alternately.

Since the spur gear 7 in FIG. 1 is not controllable, it can likewise be replaced by a cord drive 72.

As shown in FIG. 4, the spooling roller 3 can also be driven via its outer periphery and has a take-up surface 33 which is designed both for its own drive by means of the step-up gear 5 and for driving the cross-wound bobbin 11. Thus, for example, it is possible in FIG. 1 to provide, instead of the spur wheel 70, a friction wheel which rests against this take-up surface 33 and which drives the spooling roller 3 or a drive pulley 34 of this.

According to FIG. 4, the drive shaft 4 is arranged outside the spooling roller 3 and drives the latter from outside via a step-up gear 5. In the design illustrated, this step-up gear 5 possesses a cone gear 6 similar to that described with reference to FIG. 1. The cone wheel 62 is connected to a friction wheel 74 and by means of this drives the spooling roller 3 as a whole or only its drive pulley 34 which, like the friction wheel 74 and the cone wheel 62, is carried by the bearing 66. In this exemplary embodiment, the spooling roller 3 is mounted on an axle 39 carried by two bearings 390 and 391. The conical cross-wound bobbin 11 is again controlled in the way described. Here, the output part, connected rigidly to the spooling roller 3, of a friction gear following the step-up gear 5 is formed by the take-up surface 33, while the drive part of this friction gear is formed by a friction wheel 74 connected to the cone wheel 62.

In the exemplary embodiments described above, the transmission element 61 of the cone gear 6 and thus the second regulating system 51 is controlled from a control device 9 which itself is controlled electrically from the thread-tension sensor 90, that is to say the first regulating system 96. In principle, here again, the design of the thread-tension sensor 90 is unimportant. Thus, for example, it can operate in a contactless manner and detect the thread tension as a function of a measured loop size or in any other suitable way.

FIG. 5 illustrates a design in which this control of the transmission member 61 is effected mechanically from the thread-tension sensor 90. Here, the thread-tension sensor 90, made of plastic for easy movement, has a bar 91 supported pivotably on an axle 93 by means of a mounting 92. The axle 93 is carried by a bearing 94. The bar 91 is stressed elastically by a torsion spring 95 and is always held up against the thread 10 as a result of the action of this torsion spring 95 and is thus pivoted as a function of the thread-tension. For this purpose, one end of the torsion spring 95 is anchored in the bearing 94, and the other end of the torsion spring 95 is anchored in the mounting 92.

The mounting 92 carries off-center on its circular end face 920 an engaging pin 921 engaging into a slot 820 of an engagement block 82 which is part of a linkage 81 connecting the bar 91 to the adjusting fork 80. The engagement block 82 is arranged on a connecting rod 83 which at its other end carries a further engagement block 84. This further engagement block 84 is connected via an angle lever 85 mounted on the machine frame 18 to a further drive rod 86 which is guided parallel to the drive shaft 4 by means of a guide 87. This drive rod 86 carrys the adjusting fork 80 which by means of its pairs of engaging pins 800 and 801 (only one pin of each pair being visible) engages round the transmission member 61 of the cone gear 6 (see also FIG. 1).

In the design illustrated in FIG. 5, a slot 820 oriented in the direction of movement of the connecting rod 83 is provided in the engagement block 82, so that slight variations in the thread tensions do not result immediately in an adjustment of the transmission member 61. Thus, the thread-tension sensor 90 is capable of compensating relatively small variations in the thread tension without causing an adjustment of the transmission member 61. As already mentioned, this thread-tension sensor 90 thus constitutes a first regulating system 96 for compensating periodic variations in thread tension, such as arise as a result of the traversing of the thread 10 by means of the traversing thread guide 17 (see FIG. 1). During the formation of conical cross-wound bobbins 11 or even during the formation of the first layers on an empty tube 22, this first regulating system 96 fully suffices to absorb small variations in thread tension.

Figure 6:
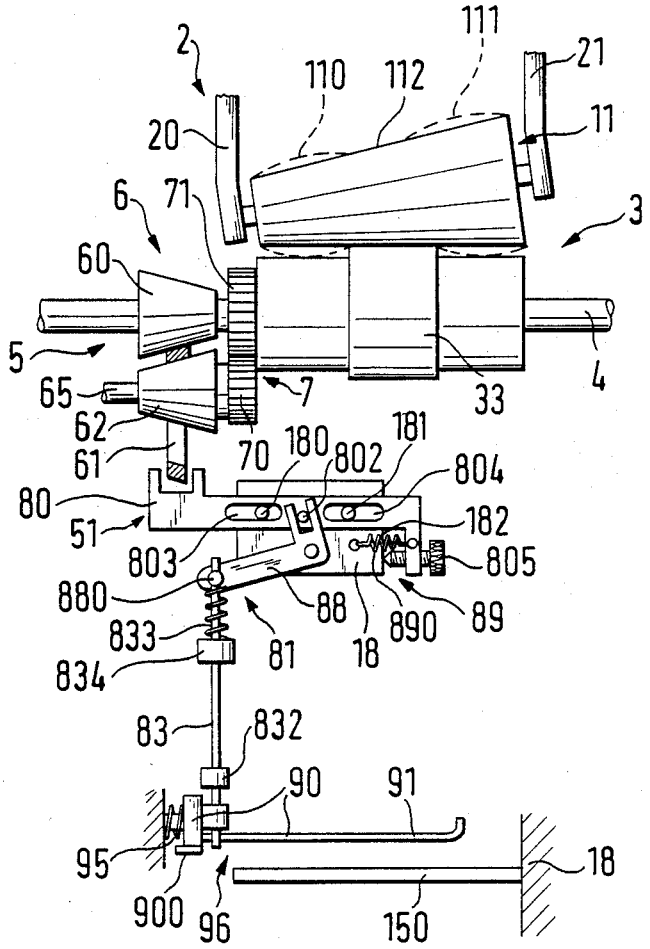
FIG. 6 shows, in a diagrammatic plane view, an embodiment of the apparatus according to the invention with a return device for an adjusting fork controlling the transmission member.

Even shortly after the start of the winding-on operation, the thread begins to fill the gaps between the spooling roller 3 and cross-wound bobbin 11 outside the take-up surface 33 (see the regions 110 and 111 in FIG. 6). In these regions 110 and 111, the bobbin circumference is therefore greater than in the driven region 112, so that more thread 10 is wound on in the regions 110 and 111 of larger circumference than corresponds to the drive speed of the cross-wound bobbin 11 in its driven region 112. This leads to an increase in tension in the thread 10, so that the thread-tension sensor 90 is pivoted out of the original range I–II (see FIG. 7) into the range II–III. The engaging pin 921 thereby comes up against the engagement block 82 and causes an adjustment of the transmission mmber 61 via the linkage 81, so that the step-up ratio of the step-up gear 5 is changed. Thus, when specific thread-tension limiting values determined as a result of the contact of the thread-tension sensor 90 against the engagement block 82 are exceeded, the winding-on speed of the thread 10 is reduced, so that the variations in thread tension are brought into the original range again. The thread-tension sensor 90 now moves again into the range I–II, where it compensates the periodic thread fluctuations by means of a pendulum movement, while the adjusted transmission member 61 ensure the higher winding-on speed.

The step-up gear 5 thus constitutes the abovementioned second regulating system 51 for compensating shifts in a range of variations in thread tension.

Since these shifts in range depend on the diameter of the cross-wound bobbin 11, in contrast to the design described the second regulating system 51 can also operate independently of the first regulating system 96, because the second regulating system 51 is controlled as a function of an increase in the bobbin diameter. However, a more accurate control of the thread tension and consequently also of the bobbin quality is possible when the second regulating system 51 can be activated by the first regulating system 96 in the event of a shift in the predetermined range of variations in thread tension.

The range of variations in thread tension which are to have no effect on the second regulating system 51 can be adjusted according to FIG. 5. As this Figure shows, to match the accuracy of response to the particular requirements desired there is in the engagement block 82, parallel to the connecting rod 83, a set screw 821 which projects into the orifice 820 designed as a slot. As a result of the adjustment of this set screw 821, the length of the orifice 820 and consequently the responsiveness of the apparatus can be varied.

When every change in the thread tension is to result in a control movement, the setscrew 821 must be adjusted accordingly or a cylindrical orifice for receiving the engaging pin 921 provided instead of the slot 820.

When a spooling station is inoperative, to allow the thread-sensing bar 91 to move out of its position of rest, in which it is up against a stop pin 940 carried by the bearing 94, the two engagement blocks 82 and 83 are not connected rigidly to the connecting rod 83. As shown in FIG. 5, there is in front of each engagement block 82 and 84 (as seen by the observer) an elastic coupling member 830, 833 which is designed as a compression spring and which is supported on the connecting rod 83 via a set collar 831, 834. A stop 832 and an engaging ring 835 are arranged respectively on the side of each of the two engagement blocks 82 and 84 which faces away from the elastic coupling member 830, 833.

In the construction described, every movement of the thread-sensing bar 91 is transmitted to the drive rod 86 via the elastic coupling members 830 and 833.

According to FIG. 5, the thread-sensing bar 91 is up against the stop pin 940. When this thread-sensing bar 91 is pivoted away from the stop pin 940, the engaging pin 921 executes a circular movement, and a component of the movement of the engaging pin 921 located in the slot 820 is always oriented in the direction of the coupling member 830. When the drive rod 86 is blocked because the spooling station is stopped and the transmission member 61 consequently cannot be adjusted, the engagement block 82 taken up by the engaging pin 921 can take the connecting rod 83 with it via the elastic coupling member 830 only until the engaging ring 835 comes up against the engagement block 84. The further movement of the engagement block 82 is absorbed by the elastic coupling member 830.

When the thread-sensing bar 91 moves in the opposite direction towards the stop pin 940, the engagement block 82 comes up against the engaging ring 832. If the drive rod 86 is blocked, so that the engagement block 84 cannot follow the movement of the connecting rod 83, the further movement of the connecting rod 83 is absorbed by the elastic coupling member 833.

FIG. 6 illustrates a modification of the apparatus described, by means of which periodic variations in thread tension are likewise compensated and, in addition, predetermined thread-tension limiting values are prevented from being exceeded as a result of a change in the winding-on speed. As in the exemplary embodiment shown in FIG. 5, the first regulating system 96 possesses a thread-tension sensor 90 which is mounted rotatably about an axle 93 and which is prestressed by a torsion spring 94 (see FIG. 5). Underneath the bar 91, the thread 10 is guided by the draw-off rollers 13, 14, while above the bar 91 it is guided by a thread guide 150 held by the machine frame 18.

The thread-tension sensor 90 is designed as a guide for the connecting rod 83 which carries a stop 832. This stop 832 is adjustable and assumes such a position on the connecting rod 83 that the thread-tension sensor 90 can pivot freely within the range I–II (see FIG. 7) to compensate periodic variations in thread tension, without running up against the stop 832. The setting of the stop 832 on the connecting rod 83 thus fixes the limit between the range I–II and the range II–III and consequently the threaded-tension limiting values.

The connecting rod 83 is guided in a guide 880 at the end of an angle lever 88 and is supported elastically on this guide by means of a set collar 834 and an elastic coupling member 833. The angle lever 88 is mounted on the machine frame 18 and by means of its free end surrounds an engaging pin 802 of the adjusting fork 80 which is guided parallel to the drive shaft 4 of the spooling roller 3 by means of two slots 803 and 804 and two guide bolts 180 and 181 carried by the machine frame 18.

The adjusting fork 80 carries a stop 805 which interacts with a fixed stop 182 of the machine frame 18. In the exemplary embodiment illustrated, one of the stops, in particular the stop 805 of the adjusting fork 80, is adjustable and is consequently designed as a set screw. A return device 89 is also provided. According to the design illustrated in FIG. 6, this is designed as a restoring spring 890, one end of which is anchored to the machine frame 18 and the other end of which is anchored to the adjusting fork 80.

When no force is transmitted by the first regulating system 96 to act on the second regulating system 51, the adjusting fork 80 and consequently also the transmission member 61 assume, because of the return device 89, a basic position which is fixed by the stops 182 and 805. The fixing of the basic position results in a fixing of the step-up ratio of the step-up gear 5. Thus, the yarn winding tension of the spooling station depends on the arrangement or adjustment of the stops 182 and 805. Consequently, the maximum step-up ratio which cannot be exceeded, that is to say the maximum circumferential speed of the cross-wound bobbin 11, is fixed by the adjusting stop 805.

When, as the cross-wound bobbin 11 increases in size the periodic thread tensions shift into another tension range because the regions 110 and 111 have increased out of proportion and because of the higher winding-on speed generated as a result, the thread-tension sensor 90 reacts to this by deflecting into the range II–III. The thread-tension sensor 90 thus comes up against the step 832 and lifts the adjusting fork 80 off from the stop 182 via the connecting rod 83 and the angle lever 88. The adjusting fork 80 thereby moves the transmission member 61, for example a rigid collar, out of its basic position, so that it passes into the region of larger diameter of the cone wheel 60 and into the region of smaller diameter of the cone wheel 62. The spooling roller 3 is thus now driven at a lower rotational speed to prevent shifts in the range of variations in thread tension, so that the circumferential speed of the cross-wound bobbin 11 driven by the spooling roller 3 is also reduced. In this way, the winding-on speed is reduced, the thread tension diminishes and the thread-tension sensor 90 returns to the range I–II.

Because the adjusting fork 80 is stressed by the restoring spring 890, the adjusting fork 80 tends to bring the transmission member 61 back into the initial position. The resulting increase in the circumferential speed of the cross-wound bobbin 11 again leads to an increase in the thread tension and consequently to a shift of the variations in thread tension into the range II–III. This cycle is repeated until an equilibrium occurs at the transition between the ranges I–II and II–III. Furthermore, the percentage differences in diameter between the regions 110, 111 and 112 of the cross-wound bobbin 11 become less and less as the bobbin increases in size, so that the deflections of the thread-tension sensor 90 also become smaller and smaller.

The return device 89 can also be used in the exemplary embodiments illustrated in FIGS. 1 to 5. It prevents the thread-tension sensor 90 from adjusting the transmission member 61 too far when it leaves the range I–II, so that as a result of the decrease in thread tension caused thereby the thread-tension sensor 90 has to execute a counter-control immediately, for example by means of a coupling member 830 and a set collar 831 (FIG. 5). Because of this, there may be the danger that the variations in thread tension can finally no longer be compensated, but build up increasingly. However, this is reliably prevented by means of the return device.

Figure 7:
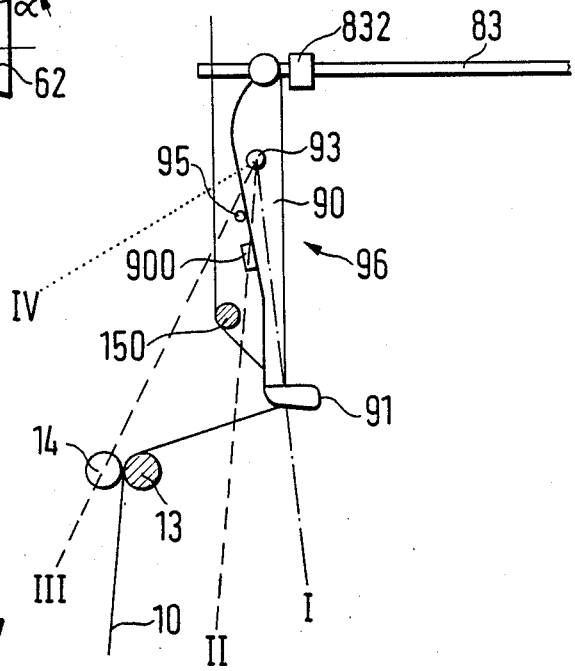
FIG. 7 shows, in a side view, a thread-tension sensor which can be brought into various regions.

According to FIGS. 6 and 7, the thread-tension sensor 90 has a nose 900 which extends essentially parallel to the drive shaft 4 and to the spooling roller 3. An arm (not shown) of a servicing device movable along the machine can interact with this nose 900, to pivot the thread-tension sensor 90 out of the thread run into the position IV, for example for a piecing operation. Since the adjusting fork 80 resting against the stop 182 cannot follow this movement, when the thread-tension sensor 90 pivots into the position IV the coupling member 833 arranged between the connecting rod 83 and the transmission member 61, that is to say the adjusting fork 80, absorbs the additional travel.

Figure 8:
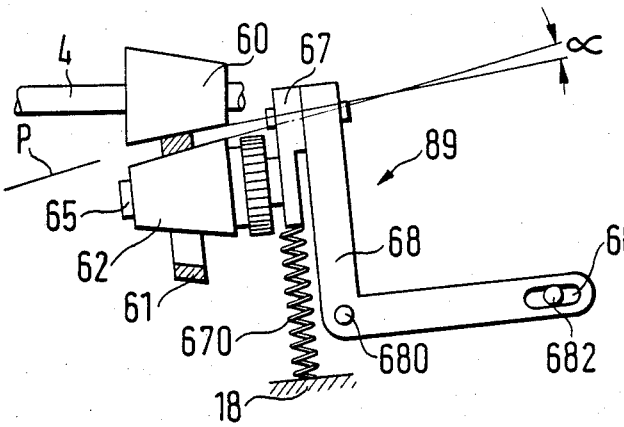
FIG. 8 shows, in a front view, another embodiment of a return device for the transmission member.

FIG. 8 illustrates another design of a return device 89. Here, the cone wheel 62 is mounted on an axle 65 which has an inclination relative to the drive shaft 4 with the cone wheel 60. Although both cone wheels 60 and 62 have the same conicity, as a result of this inclination the outer surfaces of the cone wheels 60 and 62 converge, so that a force component P acts on the transmission member 61 and urges the transmission member 61 back into the basic position.

According to FIG. 8, this convergence (the angle $\alpha$) can be adjusted because the cone wheel 62 is mounted on an angle lever 68 via an intermediate lever 67. This angle lever 68 is pivotable about an axle 680, the free end having a slot 681 into which an adjusting cam 682 engages. The intermediate lever 67 is stressed by a compression spring 670 which is supported in a suitable way on a fixed part of the machine frame 18.

Figure 9:
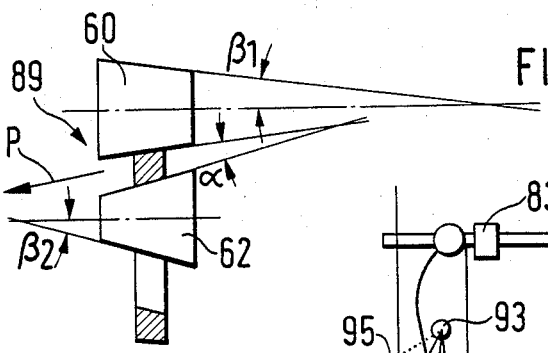
FIG. 9 shows, in a side view, a further embodiment of a return device for the transmission member.

According to FIG. 9, the convergence (the angle $\alpha$) is obtained because the two cone wheels 60 and 62 have different conicities (see the angles $\beta_1$ and $\beta_2$), with the result that a force component P again acts on the transmission member 61 and urges the latter back into the basic position. To guarantee that the transmission member 61 has a long service life, its inner and outer peripheral surfaces have the same coinicities as the two cone wheels 60 and 62, so that the conicities of the transmission member 61 and of the cone wheels 60 and 62 are matched with one another.

The foregoing description shows that the subject of the application can be modified in many ways. Further modifications are possible as a result of the interchange of features or the substitution of equivalents for them and combinations of these and come within the scope of the present invention. Thus, for example, instead of the stops 805 and 182 assigned to the adjusting fork 80, a stop onto which the transmission member 61 runs can also be provided, so that this stop limits the maximum adjustment travel of the transmission member 61 in an adjusting direction.

I claim:

1. Apparatus for winding thread supplied at a constant speed and with a traversing thread guide onto a cross-wound bobbin so that variations in thread tension are automatically compensated for, said apparatus comprising:

a drive shaft driven at a constant rotational speed;

a drive roll for driving the bobbin during the winding operation, supported about an axis defined by said drive shaft for free rotation thereabout in a fixed axial position;

compact variable speed transmission means for controllably transmitting selected amounts of rotational power from said drive shaft to said drive roll, said transmission means including at least a two-stage mechanism with a drive member rotatably supported on the same axis supporting said drive roll so as to minimize space required by said transmission means, an output member receiving rotational power from said drive member and mounted on an axis separate therefrom, rotatable coupling means for drivingly coupling said drive roll to said output member for transmission of rotational power to said drive roll, and an actuable transmission member for effecting changes in said rotational power transmitted to said drive roll through said rotatable coupling means by varying a drive ratio between said drive member and said output member, actuation of said actuable transmission member being isolated from said rotatable coupling means;

first regulating means for measuring tension in thread being wound on the bobbin and detecting variations therein, for automatically compensating for minor variations in said tension such as periodic fluctuations induced by operation of the transversing thread guide, and for outputting an indication of detected variations outside a predetermined range of thread-tension limiting values;

stabilizing means for biasing said first regulating means relative thread being wound on the bobbin so as to tend to maintain said first regulating means in a fixed position corresponding to a given yarn tension, so that said first regulating means stably reacts to changes in the tension of such thread;

second regulating means, responsive to said indication output by said first regulating means, for actuating said variable speed transmission means actuable transmission member to vary the rotational speed of said drive roll so as to wind thread onto the bobbin at uniform tension throughout the winding process; and restoring means, operative with said second regulating means, for urging same towards a basic position so as to maintain thread tension by biasing said second regulating means for greatest drive roll rotational speed within a determined range of thread-tension variations, so as to maintain an effective compensation range for said second regulating means; whereby uniform tension without respect to changes in the weight of the bobbin as thread is wound thereon is achieved with stable operation, which includes compensating for periodic thread-tension fluctuations while tending to prevent thread-tension limiting values from being exceeded due to varying of bobbin drive roll speed.

2. An apparatus as set forth in claim 1, wherein said drive member and said output member comprise friction mating conical rolls, and said actuable transmission member thereof comprises an axially movable transmitting member, interposed between said conical rolls.

3. An apparatus as set forth in claim 2, wherein said transmitting member comprises a rigid collar interposed between said conical rolls.

4. An apparatus as set forth in claim 3, wherein the outer surfaces of said collar have conicities matching the conicities of said conical rolls of said variable speed transmission means.

5. An apparatus as set forth in claim 2, further comprising a return device for returning said transmitting member to an adjustable basic position, which position determines the maximum amount of rotational power transmitted by said transmission means.

6. An apparatus as set forth in claim 5, further including an adjustable stop, placement of which establishes said basic position.

7. An apparatus as set forth in claim 6, further including an adjusting fork which is stressed by said return device, with movement of said transmitting member and said fork being controlled by said adjustable stop.

8. An apparatus as set forth in claim 7 wherein said adjustable stop is disposed on said adjusting fork.

9. An apparatus as set forth in claim 5, wherein said return device comprises a return spring.

10. An apparatus as set forth in claim 5, wherein: said return device comprises converging outer surfaces of said conical rolls.

11. An apparatus set forth in claim 10, wherein the conical roll forming said output member is mounted on an axle which is inclined relative to said drive shaft carrying the conical roll forming the drive member.

12. An apparatus as set forth in claim 11, further including means for adjusting the inclination of the axle of the cone wheel forming said output part.

13. An apparatus as set forth in claim 12 further comprising a lever on which said adjustable axle is mounted, and an adjusting cam associated therewith for adjusting same.

14. An apparatus as set forth in claim 10, wherein the conical rolls have different conicities.

15. An apparatus as set forth in claim 14, wherein the outer surfaces of the transmitting member have different conicities matching the conicities of the conical rolls.

16. An apparatus as set forth in claim 1, wherein said actubale transmission member is continuously engaged between said drive member and said output member.

17. An apparatus as set forth in claim 1 wherein said first regulating means includes a resiliently mounted bar which presses against the thread during operation of said apparatus.

18. An apparatus as set forth in claim 17, wherein the resiliency of said bar is selected to permit bar movement of a predetermined distance to compensate for minor variations in thread tension before said first regulating means indication is output to said second regulating means.

19. Apparatus as set forth in claim 18, further comprising linkages resiliently connecting said bar to said second regulating means and adapted to adjust the amount of rotational power said variable transmission means transmits between said drive shaft and said drive roll mounted freely rotatable about said drive shaft.

20. An apparatus as set forth in claim 19, wherein said linkages comprise a connecting rod, extending between said first and second regulating means with a guide member for receiving said connecting rod, and an adjustable stop received on said rod for limiting movement thereof.

21. An apparatus as set forth in claim 18, further including electronically-operative associating means between said bar and said second regulating means for varying the drive speed of said drive roller.

22. An apparatus as set forth in claim 18, further comprising a slotted connection located between said bar and said second regulating means for adjusting said variable transmission means.

23. An apparatus as set forth in claim 22, further including means for adjusting the length of the slot in the slotted connection.

24. An apparatus a set forth in claim 17, wherein said first regulating means includes a nose element extending parallel to said drive roll, adaped for external actuation with a servicing device.

25. An apparatus as set forth in claim 17, wherein said first regulating means includes a member made out of a plastic material.

26. An apparatus as set forth in any one of claims 1, 2, or 16, wherein said drive shaft extends through said drive roll, with said drive roll supported thereon for free rotation about said drive shaft.

27. An apparatus as set forth in claim 1, wherein said coupling means includes gear means.

28. An apparatus as set forth in claim 1, wherein said coupling means includes a cord drive device.

29. An apparatus as set forth in claim 1, wherein said apparatus winds conical cross-wound bobbins and wherein said rotatable coupling means is situated adjacent to the smaller diameter of such conical cross-wound bobbin.

30. An apparatus as set forth in claim 29, wherein the drive roll has at least two loose pulleys and a drive pully arranged between said loose pulleys.

31. An apparatus as set forth in claim 30, further including means for arranging sid drive pulley between said loose pulleys in a manner which permits it to be offset in the axial direction towards the larger diameter of the conical cross-wound bobbin.

32. An apparatus as set forth in claim 30, wherein said drive pulley is connected through a sleeve-like connecting piece to a drive element which is provided relatively adjacent one axial end of said drive roll and is driven by said variable speed transmission means, wherein said loose pulley disposed between said drive pulley and said drive element are mounted on such connecting piece.

33. An apparatus as set forth in claim 32, wherein the drive pulley has, on its end facing away from the sleeve like connecting piece, a sleeve like extension for mounting at least one further loose pulley.

34. An apparatus as set forth in claim 1, wherein the drive roll has a profiled drive surface for enhancing thread take-up on said bobbin.

35. Apparatus for winding thread supplied at a constant speed and with a traversing thread guide onto a cross-wound bobbin so that variations in thread tension are automatically compensated for, said apparatus comprising:

a drive shaft driven at a constant rotational speed;

a drive roll for driving the bobbin during the winding operation, supported about said drive shaft for free rotation thereabout in a fixed axial position;

variable speed transmission means for controllably transmitting selected amounts of rotational power from said drive shaft to said drive roll, rotatable coupling means for drivingly coupling said drive roll to said variable speed transmission means for transmission of rotational power to said drive roll, said transmission means including at least a two-stage mechanism with an actuable transmission member for effecting changes in said rotational power transmitted through said rotatable coupling means to said drive roll so that actuation of said actuable transmission member is isolated from said rotatable coupling means;

first regulating means for measuring tension in thread being wound on the bobbin and detecting variations therein, for automatically compensating for minor variations in said tension such as periodic fluctuations induced by operation of the traversing thread guide, and for outputting an indication of detected variations outside a predetermined range;

second regulating means, responsive to said indication output by said first regulating means, for actuating said variable speed transmission means actuable transmission member to vary the rotational speed of said drive roll so as to wind thread onto the bobbin at uniform tension throughout the winding process; and return means for biasing said variable speed transmission means actuable transmission member to an adjustable basic position, which position determines the maximum amount of rotational power transmitted by said transmission means.

36. Apparatus for winding thread supplied at a constant speed and with a traversing thread guide onto a cross-wound bobbin so that variations in thread tension are automatically compensated for, said apparatus comprising:

a drive shaft driven at a constant rotational speed;

a drive roll for driving the bobbin during the winding operation, supported about said drive shaft for fee rotation thereabout in a fixed axial position;

variable speed transmission means for controllably transmitting selected amounts of rotational power from said drive shaft to said drive roll, rotatably coupling means for drivingly coupling said drive roll to said variable speed transmission means for transmission of rotational power to said drive roll, said transmission means including at least a two-stage mechanism with an actuable transmission member for effecting changes in said rotational power transmitted through said rotatable coupling means to said drive roll so that actuation of said actuable transmission member is isolated from said rotatable coupling means;

first regulating means for measuring tension in thread being wound on the bobbin and detecting variations therein, for automatically compensating for minor variations in said tension such as periodic fluctuations induced by operation of the traversing thread guide, and for outputting an indication of detected variations outside a predetermined range; and second regulating means, responsive to said indication output by said first regulating means, for actuating said variable speed transmission means actuable transmission member to vary the rotational speed of said drive roll so as to wind thread onto the bobbin at uniform tension throughout the winding process; wherein said first regulating means includes a resiliently mounted bar which presses against the thread during operation of said apparatus, and further includes a nose element extending parallel to said drive roll, adapted for external actuation with a servicing device.

37. Apparatus for winding thread supplied at a constant speed and with a traversing thread guide onto a cross-wound bobbin so that variations in thread tension are automatically compensated for, said apparatus comprising:

a drive shaft driven at a constant rotational speed;

a drive roll for driving the bobbin during the winding operation, supported about said drive shaft for free rotation thereabout in a fixed axial position;

variable speed transmission means for controllably transmitting selected amounts of rotational power from said drive shaft to said drive roll, rotatable coupling means for drivingly coupling said drive roll to said variable speed transmission means for transmission of rotational power to said drive roll, said transmission means including at least a two-stage mechanism with an actuable transmission member for effecting changes in said rotational power transmitted through said rotatable coupling means to said drive roll so that actuation of said acutable transmission member is isolated from said rotatable coupling means;

first regulating means for measuring tension in thread being wound on the bobbin and detecting variations therein, for automatically compensating for minor variations in said tension such as periodic fluctuations induced by operation of the traversing thread guide, and for outputting an indication of detected variations outside a predetermined range; and second regulating means, responsive to said indication output by said first regulating means, for actuating said variable speed transmission means actuable transmission member to vary the rotational speed of said drive roll so as to wind thread onto the bobbin at uniform tension throughout the winding process; wherein said first regulating means includes a resiliently mounted bar which presses against the thread during operation of said apparatus and accepts minor variations in tension of such thread without outputting said first regulating means indicating; and wherein said apparatus further includes a slotted connection, including an adjustable length slot, located between said bar and said second regulating means for adjusting said variable speed transmission means.

38. Apparatus for winding thread supplied at a constant speed and with a traversing thread guide onto a cross-wound bobbin so that variations in thread tension are automatically compensated for, said apparatus comprising:

a drive shaft driven at a constant rotational speed;

a drive roll for driving the bobbin during the winding operation, supported about said drive shaft for free rotation thereabout in a fixed axial position;

variable speed transmission means for controllably transmitting selected amounts of rotational power from said drive shaft to said drive roll, rotatable coupling means for drivingly coupling said drive roll to said variable speed transmission means for transmission of rotational power to said drive roll, said transmission means including at least a two-stage mechanism with an actuable transmission member for effecting changes in said rotational power transmitted through said rotatable coupling means to said drive roll so that actuation of said actuable transmission member is isolated from said rotatable coupling means;

first regulating means for measuring tension in thread being wound on the bobbin and detecting variations therein, for automatically compensating for minor variations in said tension such as periodic fluctuations induced by operation of the traversing thread guide, and for outputting an indication of detected variations outside a predetermined range; and second regulating means, responsive to said indication output by said first regulating means, for actuating said variable speed transmission means actuable transmission member to vary the rotational speed of said drive roll so as to wind thread onto the bobbin at uniform tension throughout the winding process; wherein said apparatus winds conical cross-wound bobbins;

said variable speed transmission means is disposed for driving a member connected to the drive roll and situated adjacent to the small diameter of such conical cross-wound bobbin; and said drive roll has at least two loose pulleys and a drive pulley arranged between said loose pulleys.

* * * * *